US009591422B2

(12) United States Patent
Kechichian

(10) Patent No.: US 9,591,422 B2
(45) Date of Patent: Mar. 7, 2017

(54) METHOD AND APPARATUS FOR AUDIO INTERFERENCE ESTIMATION

(71) Applicant: KONINKLIJKE PHILIPS N.V., Eindhoven (NL)

(72) Inventor: Patrick Kechichian, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 26 days.

(21) Appl. No.: 14/432,606

(22) PCT Filed: Oct. 4, 2013

(86) PCT No.: PCT/IB2013/059117

§ 371 (c)(1),
(2) Date: Mar. 31, 2015

(87) PCT Pub. No.: WO2014/057406

PCT Pub. Date: Apr. 17, 2014

(65) Prior Publication Data

US 2015/0271616 A1 Sep. 24, 2015

Related U.S. Application Data

(60) Provisional application No. 61/711,249, filed on Oct. 9, 2012.

(51) Int. Cl.
*H04R 29/00* (2006.01)
*H04R 3/02* (2006.01)
(Continued)

(52) U.S. Cl.
CPC ..... *H04R 29/004* (2013.01); *H04R 3/002* (2013.01); *H04R 3/02* (2013.01); *H04R 3/04* (2013.01);
(Continued)

(58) Field of Classification Search
None
See application file for complete search history.

(56) References Cited

U.S. PATENT DOCUMENTS 5,937,377 A 8/1999 Hardiman et al.
6,006,175 A * 12/1999 Holzrichter ..... A61B 5/0507 704/205
(Continued)

FOREIGN PATENT DOCUMENTS

WO 2007131815 A1 11/2007
WO 2012069973 A1 5/2012

OTHER PUBLICATIONS

Sorensen et al, "Speech Enhancement With Natural Sounding Residual Noise Based on Connected Time-Frequency Speech Presence Regions", EURASIP Jornal on Applied Signal Processing, vol. 18, 2005, pp. 2954-2964.
(Continued)

*Primary Examiner* — Muhammad N Edun

(57) ABSTRACT

An apparatus comprises a receiver (203) which receives a microphone signal from a microphone (201) where the microphone signal comprises a test signal component corresponding to an audio test signal. A divider (215) divides the microphone signal into a plurality of test interval signal components, each of which corresponds to the microphone signal in a time interval. A set processor (217) generates sets of test interval signal components and a similarity processor (219) generates a similarity value for each set. An interference estimator (221) determines an interference measure for individual test interval signal components in response to the similarity values. The interference measure may be used to select signal segments that can be used to adapt an audio processing algorithm which is applied to the microphone signal, such as e.g. speech enhancement or echo cancella-
(Continued)

tion. The approach may allow for a reliable interference estimate to be generated while maintaining low complexity.

32 Claims, 10 Drawing Sheets

(51) Int. Cl.
*H04R 3/04* (2006.01)
*H04R 3/00* (2006.01)
*H04R 27/00* (2006.01)

(52) U.S. Cl.
CPC ..... *H04R 27/00* (2013.01); *H04R 2227/007* (2013.01); *H04R 2227/009* (2013.01)

(56) References Cited

U.S. PATENT DOCUMENTS

| | | | | |
|---|---|---|---|---|
| 8,379,873 | B2 * | 2/2013 | Yamkovoy | H04R 29/00 381/309 |
| 8,649,530 | B2 * | 2/2014 | Kim | H04R 3/12 381/56 |
| 2006/0269080 | A1 | 11/2006 | Oxford et al. | |
| 2009/0312151 | A1 * | 12/2009 | Thieberger | A63B 24/0062 482/8 |
| 2012/0128163 | A1 | 5/2012 | Moerkebjerg et al. | |

OTHER PUBLICATIONS

Sumirtha et al, "A New Robust Hybrid Approach to Enhance Speech in Mobile Communication Systems", American Journal of Applied Sciences, vol. 8, No. 4, 2011, pp. 332-342.
Yermeche, "Subband Beamforming for Speech Enhancement in Hands-Free Communications" Introduction, Department of Signal Processing School of Engineering, Blekinge Institute of Technology, 2004, pp. 1-24.
Yermeche et al, "A Constrained Subband Beamforming Algorithm for Speech Enhancement", Part I, Department of Signal Processing School of Engineering, Blekinge Institute of Technology, 2004pp. 27-88.
Yermeche et al, "Spatial Filter Bank Design for Speech Enhancement Beamforming Applications", Part II, Department of Signal Processing School of Engineering, Blekinge Institute of Technology, 2004pp. 92-101.
Yermeche et al, "Beamforming for Moving Source Speech Enhancement", Part III, Department of Signal Processing School of Engineering, Blekinge Institute of Technology, 2004 pp. 105-125.
ITU-T Telecommunication Standardization Sector of ITU, Artifical Voices, Appendix I, Series P: Telephone Transmission Quality, Telephone Installations, Local Line Networks, p. 50, 1999, 21 Pages.
Martin, "Noise Power Spectral Density Estimation Based on Optimal Smoothing and Minimum Statistics", IEEE Transactions on Speech and Audio Processing, vol. 9, No. 5, Jul. 2001, pp. 504-512.

* cited by examiner

METHOD AND APPARATUS FOR AUDIO INTERFERENCE ESTIMATION

CROSS-REFERENCE TO PRIOR APPLICATIONS

This application is the U.S. National Phase application under 35 U.S.C. §371 of International Application No. PCT/IB2013/059117, filed on Oct. 4, 2013, which claims the benefit of U.S. Provisional Application 61/711,249, filed on Oct. 9, 2012. These applications are hereby incorporated by reference herein.

FIELD OF THE INVENTION

The invention relates to audio interference estimation and in particular, but not exclusively, to adaptation of audio processing which includes consideration of interference estimates for a microphone signal.

BACKGROUND OF THE INVENTION

Audio systems are generally developed under certain generic assumptions about the acoustic environment in which they are used and about the properties of the equipment involved. However, the actual environments in which they are used and in many cases the characteristics of the equipment may vary substantially. Accordingly, many audio systems and applications comprise functionality for adapting to the current operating characteristics. Specifically, many audio systems comprise functionality for calibrating and adapting the system e.g. to the specific acoustic environment in which they are used. Such adaptation may be performed regularly in order to account for variations with time.

Indeed, in many applications, and in particular those related to speech enhancement systems for voice communication, parameters related to an algorithm are adapted to the characteristics of a specific device and its hardware, such as e.g. characteristics of microphone(s), loudspeaker(s), etc. While adaptive signal processing techniques exist to perform such adaptation during a device's normal operation, in many cases certain parameters (especially those on which these adaptive techniques rely) have to be estimated during production in a special calibration session which is usually performed in a controlled, e.g., quiet, environment with only relevant signals being present.

Such calibration can be performed under close to ideal conditions. However, the resulting system performance can degrade when this adaptation is performed in the use environment. In such environments local interference such as speech and noise can often be present.

For example, a communication accessory containing one or more microphones which can be attached to a television, and which further is arranged to use the television's loudspeakers and onboard processing, cannot be tuned/adapted/calibrated during production since the related hardware depends on the specific television with which it is used. Therefore, adaptation must be performed by the user in his or her own home where noise conditions may result in a poorly adapted system.

As a specific example, many communication systems are often used in conjunction with other devices, or in a range of different acoustic environments. An example of one such device is a hands-free communication accessory with built-in microphones for a television based Internet telephone service. Such a device may be mounted on or near a television and can also include a video camera, and a digital signal processing unit, allowing one to use software directly via a television in order to connect to other devices and conduct two-way or multi-party communication. A challenge when developing such an accessory is the wide-range of televisions that it may be used with as well as the variations in the acoustic environments in which it should be capable of delivering satisfactory performance.

The audio reproduction chain in television sets and the environments in which they are used affect the acoustic characteristics of the produced sound. For example, some televisions use higher fidelity components in the audio chain, such as better loudspeakers capable of linear operation over a wide dynamic input range, while others apply nonlinear processing to the received audio signals, such as simulated surround sound and bass boost, or dynamic range compression. Furthermore, the audio output of a television may be fed into a home audio system with the loudspeakers of the television muted.

Speech enhancement systems apply signal processing algorithms, such as acoustic echo cancellation, noise suppression, and de-reverberation to the captured (microphone) signal(s) and to transmit a clean speech signal to the far-end call participant. The speech enhancement seeks to improve sound quality e.g. in order to reduce listener fatigue associated with long conversations. The performance of such speech enhancement may depend on various characteristics of the involved equipment and the audio environment.

The fact that such devices are used in such a wide range of situations makes it difficult to deliver a speech enhancement system that performs consistently well. Therefore, speech enhancement systems are usually adapted/tuned during device initialization and/or runtime when the system detects poor speech enhancement performance. Most adaptation routines employ a test signal which is played back by the sound reproduction system of the connected device and recorded by the capturing device to estimate and set acoustic parameter values for the speech enhancement system.

As a simple example of a tuning routine, the measuring of the acoustic impulse response of a room may be considered. Listening environments, such as e.g. living rooms, are characterized by their reverberation time, which is defined as the time it takes an acoustic impulse response of a room to decay by a certain amount. For example, $T_{60}$ denotes the amount of time for the acoustic impulse response tail of a room to decay by 60 dB.

A test signal, such as white noise, can be rendered by a device's loudspeaker and the resulting sound signal can be recorded with a microphone. An adaptive filter is then used to estimate the linear acoustic impulse response. From this impulse response, various parameters, such as $T_{60}$, can be estimated and used to improve the performance of the speech enhancement system, e.g. by performing de-reverberation based on the reverberation time. As a specific example, reverberation time is often measured using an energy decay curve given as:

$$EDC(t) = \int_t^{\infty} h^2(\tau)\, d\tau$$

where h(t) is the acoustic impulse response. An acoustic impulse response and its corresponding energy decay curve is shown in FIG. 1.

However, a significant problem associated with adaptation procedures based on audio test signals is that they tend to be affected by the presence of interfering sound. Specifically, if there is an interfering sound source, this will cause the captured signal to be distorted relative to the rendered audio signal thereby degrading the adaptation process.

For example, when determining an acoustic impulse response of a room, the signal captured by the microphone can be contaminated by interfering sound sources that may result in errors in the impulse response estimate, or which may even result in the impulse response estimation failing to generate any estimate (e.g. due to an adaptive filter emulating the estimated impulse response failing to converge).

Adaptation routines for audio processing, such as e.g. for speech enhancement systems usually assume that only known and appropriate sound sources are present, such as specifically test sounds that are used for the adaptation. For example, to tune an acoustic echo cancellation system, the signal captured by the microphone should only contain the signal produced by the loudspeaker (echo). Any local interference such as noise sources or near-end speakers in the local environment will only deteriorate the resulting performance.

As it is typically impossible to guarantee that no other sounds sources than those used in the adaptation are present, it is accordingly often critical that it can be estimated whether interferences are present, and if so it is often advantageous to estimate how strong the interference is. Therefore, an interference estimate is often critical for adaptation of audio processing, and especially it is desirable if a relatively accurate interference estimate can be generated without overly complex processing. Indeed, interference estimates may be suitable for many audio processing algorithms and approaches, and accordingly there is a desire for improved approaches for determining an audio interference estimate.

Hence, an improved approach for generating an audio interference measure would be advantageous and in particular an approach allowing increased flexibility, reduced complexity, reduced resource usage, facilitated operation, improved accuracy, increased reliability and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an apparatus comprising: a receiver for receiving a microphone signal from a microphone, the microphone signal comprising a test signal component corresponding to an audio test signal captured by the microphone; a divider for dividing the microphone signal into a plurality of test interval signal components, each test interval signal component corresponding to the microphone signal in a time interval; a set processor for generating sets of test interval signal components from the plurality of test interval signal components; a similarity processor for generating a similarity value for each set of test interval signal components; an interference estimator for determining an interference measure for individual test interval signal components in response to the similarity values.

The invention may allow an improved and/or facilitated determination of an audio interference measure indicative of a degree of audio interference present in a microphone signal. The approach may allow a low complexity and/or reliable detection of the presence of interference in the acoustic environment captured by the microphone. The interference measure may be an input to other audio processing algorithms that utilize or operate on the microphone signal.

The approach allows for a low complexity interference determination. A particular advantage is that the system does not need explicit knowledge of the details of the audio test signal as the interference measure can be determined from a direct comparison of different parts of the microphone signal and does not require comparison to a known, predetermined reference signal.

The approach may facilitate inter-operation with other equipment and may be added to existing equipment.

In some embodiments, the apparatus may further comprise a test signal generator for generating a test signal for reproduction by an audio transducer, thereby generating the audio test signal. The audio test signal may advantageously have repetition characteristics and may comprise or consist in a number of repetitions of a fundamental signal sequence.

The apparatus may assume that the microphone signal comprises the audio test signal. Thus, the interference measure may be determined under the assumption of the test signal component being present in the microphone signal. It is not necessary or essential for the apparatus to determine or be provided with information indicating that the test signal is present.

In accordance with an optional feature of the invention, the apparatus further comprises a calibration unit for adapting a signal processing in response to the test interval signal components, the adaptation unit being arranged to weigh at least a first test interval signal component contribution in response an interference estimate for the first time interval.

The invention may provide an improved adaptation of audio signal processing algorithms. In particular, the sensitivity to and degradation caused by non-stationary audio interference may be substantially reduced.

The weighting may for example be directly of the time interval signal components or may e.g. be of the adaptation parameters generated in response to the time interval signal components.

In accordance with an optional feature of the invention, the apparatus further comprises a calibration unit for adapting a signal processing in response to the test interval signal components, the adaptation unit being arranged to weigh at least a first test interval signal component contribution in response an interference estimate for the first time interval.

This may improve adaptation. In particular, it may allow for low complexity yet improve performance. The approach may allow time interval signal components experiencing too high audio interference to be discarded thereby preventing that they introduce degradations to the adaptation.

In accordance with an optional feature of the invention, the apparatus further comprises a stationary noise estimator arranged to generate a stationary noise estimate and to compensate at least one of the threshold and the interference estimate in response to the stationary noise estimate.

This may allow for a more accurate interference measure and specifically may allow for a more accurate detection of time interval signal components experiencing too much non-stationary interference.

The stationary noise estimate may specifically be a noise floor estimate.

In accordance with an optional feature of the invention, the apparatus further comprises a test signal estimator arranged to generate a level estimate for the test signal component and to compensate at least one of the threshold and the interference estimate in response to the level estimate.

This may allow for a more accurate interference measure and specifically may allow for a more accurate detection of time interval signal components experiencing too much non-stationary interference.

Many similarity measures and accordingly interference measures may be dependent on the signal energy and compensating for the test signal energy may result in a more accurate interference measure.

Specifically, the test signal component may be an echo component from a loudspeaker of the system, and by compensating for the echo, improved performance can be achieved.

In accordance with an optional feature of the invention, the divider is arranged to divide the microphone signal into the plurality of test interval signal components in response to repetition characteristics of the audio test signal.

This may provide improved performance and facilitate operation. The divider may specifically divide the microphone signal into the plurality of test interval signal components in response to a duration and/or timing of the repetitions of the audio test signal. The time interval signal components may be synchronized with repetitions of the audio test signal.

In accordance with an optional feature of the invention, the audio test signal comprises a plurality of repetitions of an audio signal component, and a timing of the test interval signal components corresponds to a timing of the repetitions.

This may allow improved performance and/or facilitated operation. Each time interval signal component may specifically correspond to an interval which aligns with an integer number of repetitions of the audio signal component.

In accordance with an optional feature of the invention, the interference estimator is arranged to, for a first test interval signal component of the plurality of test interval signal components, determine a maximum similarity value for similarity values of sets including the first test interval signal component; and to determine the interference measure for the first test interval signal component in response to the maximum similarity value.

This may improve performance and/or reduce complexity. In particular, it may increase the probability of identifying time interval signal components experiencing low audio interference.

In accordance with an optional feature of the invention, the divider is arranged to generate at least two sets comprising at least a first of the test interval signal components.

This may improve performance and/or reduce complexity. In particular, it may increase the probability of identifying time interval signal components experiencing low audio interference.

In accordance with an optional feature of the invention, each set consists of two test interval signal components.

This may improve performance and/or reduce complexity. In particular, it may increase the probability of identifying time interval signal components experiencing low audio interference.

In accordance with an optional feature of the invention, the divider is arranged to generate sets corresponding to all pair combinations of the test interval signal components.

This may improve performance and/or reduce complexity. In particular, it may increase the probability of identifying time interval signal components experiencing low audio interference.

According to an aspect of the invention there is provided a method of generating an audio interference measure, the method comprising: receiving a microphone signal from a microphone, the microphone signal comprising a test signal component corresponding to an audio test signal captured by the microphone; dividing the microphone signal into a plurality of test interval signal components, each test interval signal component corresponding to the microphone signal in a time interval; generating sets of test interval signal components from the plurality of test interval signal components; generating a similarity value for each set of test interval signal components; and determining an interference measure for individual test interval signal components in response to the similarity values.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to generate an audio interference estimate for an audio processing adaptation application, but it will be appreciated that the invention is not limited to this application but may be applied to many other audio applications.

Figure 2:
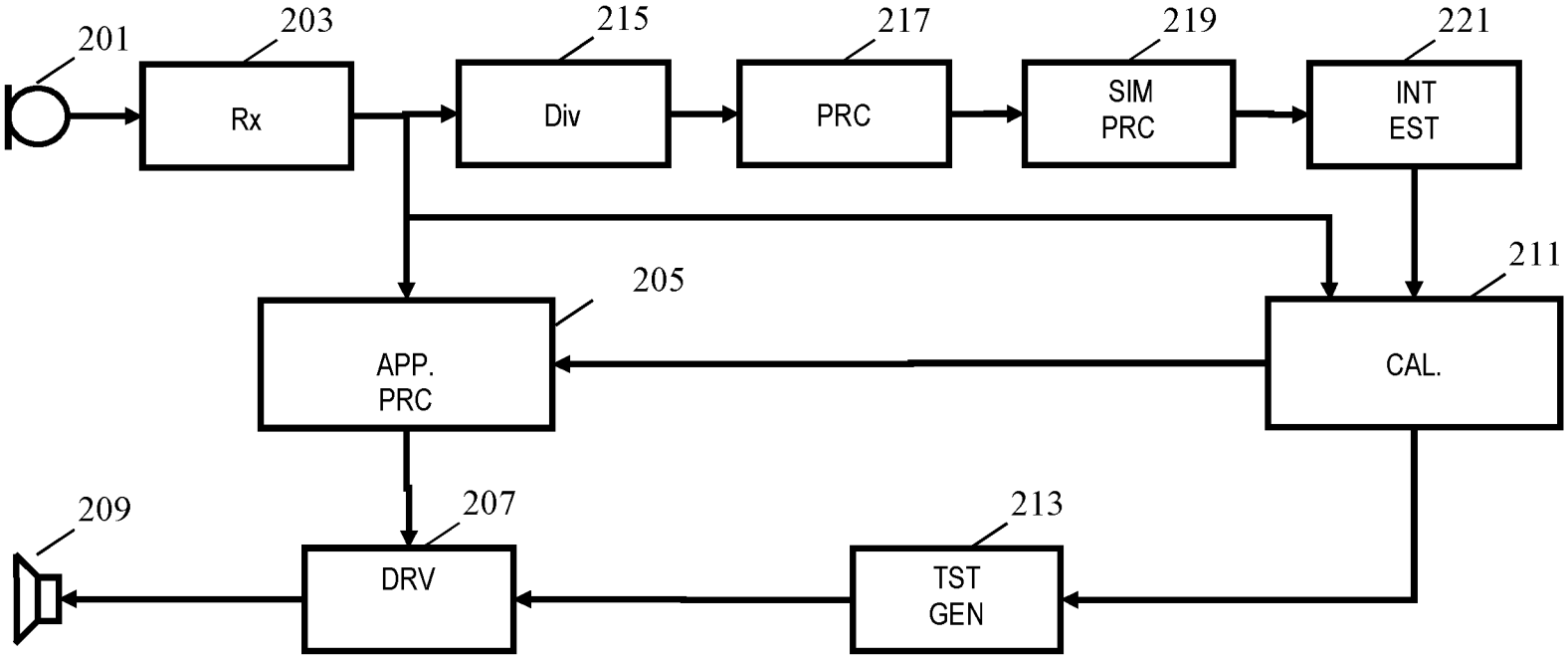
FIG. 2 illustrates an example of elements of an audio processing system in accordance with some embodiments of the invention.

FIG. 2 illustrates an example of an audio processing system in accordance with some embodiments of the invention.

The audio system comprises a microphone 201 which is arranged to capture the sound in an acoustic environment. The microphone signal generated by the microphone 201 may specifically represent the sound in a room as captured at the position of the microphone 201.

The microphone 201 is coupled to a receiver 203 which receives the microphone signal. In most embodiments, the receiver 203 may comprise amplification, filtering and possibly an analog to digital converter providing a digitized version of the microphone signal thereby allowing the subsequent processing to be performed in the digital domain.

In the example, the audio processing system further comprises an application processor 205 which is arranged to support or execute an audio application. The application processor 205 receives the microphone signal from the receiver 203 and proceeds to process it in accordance with the specific audio application.

The audio application may for example be a communication application that supports two-way communication with a remote entity. However, it will be appreciated that the described principles for adaptation and interference estimation may be used with any suitable application. In the example, the application processor 205 is arranged to receive the microphone signal and process this for transmission to a remote communication unit. The processing may include speech enhancement, echo cancellation, speech encoding etc. The application processor 205 is furthermore arranged to receive audio data from the remote communication unit and to process this in order to generate a signal which can be rendered locally. Thus, the application processor 205 receives audio data from the remote unit and generates a corresponding audio output signal.

The audio processing system of FIG. 2 therefore comprises a loudspeaker driver 207 and an audio transducer, which in the specific example is a loudspeaker 209. The loudspeaker driver 207 receives the audio signal from the application processor 205 and proceeds to generate a corresponding drive signal for the loudspeaker 209. The loudspeaker driver 207 may specifically comprise amplification circuitry as will be known to the skilled person.

In the example, the application processor 205 is arranged to perform speech enhancement and specifically echo cancellation and/or suppression on the received microphone signal. The audio rendered by the loudspeaker 209 may be picked up by the microphone 201 and if this contribution is not suppressed it will result in the remote unit receiving a copy of its own signal. This will sound like an echo at the remote communication unit and accordingly the application processor 205 includes functionality for attenuating the signal component corresponding to the rendered audio from the loudspeaker 209 in the microphone signal. Such processing is known as echo cancellation.

In order for echo cancellation to perform optimally, the algorithm must be adapted to the specific characteristics of both the equipment used and the acoustic environment in which it is used. Specifically, the signal path from the application processor 205 via the loudspeaker driver 207, the loudspeaker 201, the acoustic path from the loudspeaker 209 to the microphone 201, the microphone 201, and the receiver 203 back to the application processor 205 should preferably be known as well as possible in order for the echo cancellation to adapt to cancel out the echo.

Figure 1:
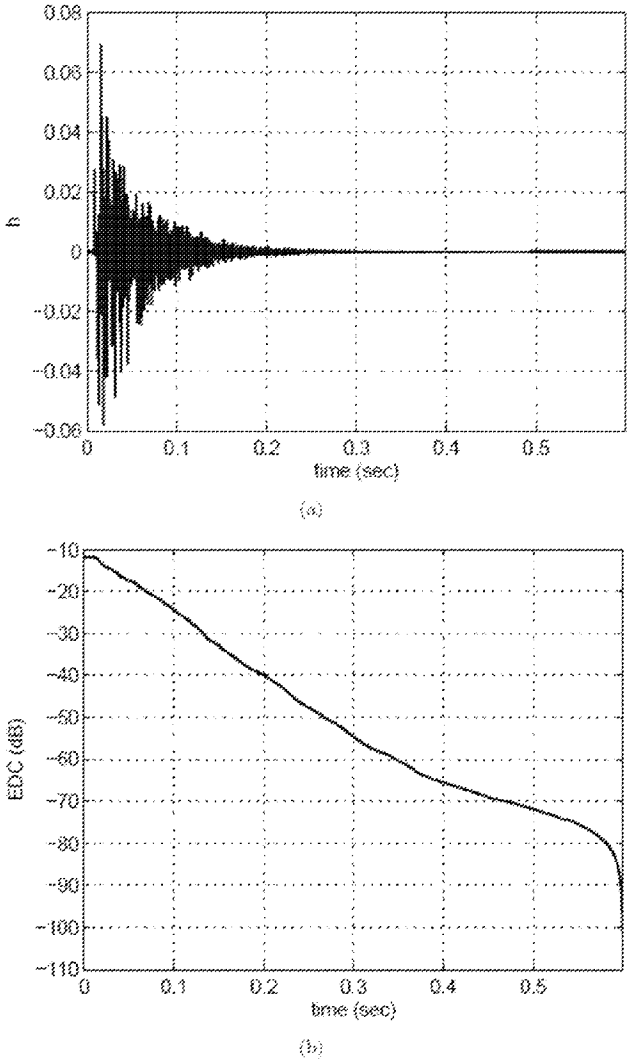
FIG. 1 illustrates an example of an acoustic impulse response and its corresponding energy decay curve for a room.

Accordingly the system of FIG. 1 includes a calibration processor 211 which is arranged to adapt the audio processing of the application processor 205. In the specific example, the calibration processor 211 is arranged to estimate the transfer function of the signal path from the application processor 205 via the loudspeaker 209 and microphone 201 back to the application processor 205, i.e. the signal path from the input to the loudspeaker driver 207 to the output of the receiver 203.

The calibration processor 211 estimates the transfer function using a test signal. The audio system accordingly comprises a test signal generator 213 which generates a test signal that is fed to the loudspeaker driver 207. The test signal is accordingly rendered by the loudspeaker 209 and part of the resulting audio test signal is captured by the microphone 201. The output of the receiver 203 is fed to the calibration processor 211 which can proceed to characterize the transfer function by comparing it to the generated test signal. The resulting impulse response/transfer function parameters are then fed to the application processor 205 and used for the echo cancellation.

It will be appreciated that different test signals and impulse response estimations may be used in different embodiments and that any suitable approach may be used. For example, the test signal may be a short pulse (corresponding to an approximation of a Dirac pulse) or may e.g. be a frequency sweep, or may e.g. be an artificial speech signal, which though unintelligible, contains spectral and time-domain characteristics similar to that of real speech.

In order for the calibration to be optimal, the only sound captured by the microphone 201 should be that of the test signal. Accordingly, the audio processing system typically does not render any other sound during the calibration operation. However, even in this case there is likely to be audio interference caused by other sound sources in the acoustic environment. For example, there may be people speaking in the room, other audio devices may be active etc. Such audio interference will degrade the estimation of the impulse response and thus result in degraded echo cancellation performance.

The audio processing system of FIG. 2 comprises functionality for generating an interference measure indicative of the amount and/or presence of audio interference. In the example, any sound not resulting from the rendering of the test signal is audio interference. Thus, the audio processing system generates a measure indicative of the degree of captured sound that is not due to the rendering of the test signal.

The interference measure may for example be used to determine when the calibration is performed by the calibration processor 211. For example, the calibration processor 211 may adapt the processing of the application processor 205 in response to the microphone signal only in time intervals for which the interference measure indicates that the audio interference is below a given level. In some embodiments, the interference measure may be used to generate a reliability indication for the generated calibration values, and e.g. the update of existing parameters in dependency on the calibration may be dependent on such a reliability measure. E.g. when the reliability is low, only marginal adaptation is employed whereas more significant adaptation is performed when the reliability is high.

In more detail, the audio processing system comprises a divider 215 which divides the microphone signal into a plurality of test interval signal components. Each of the test interval signal components corresponds to the microphone signal in a time interval.

In the example of FIG. 2, the test signal is generated such that it is a repeating signal. Specifically, the same signal may be repeated in a number of consecutive time intervals. In the system, the divider 215 is arranged to divide the microphone signal into time intervals that are synchronized with these repetition time intervals. Specifically, the divider 215 divides the microphone signal into time intervals that have a duration which is a multiple of the repetition duration of the test signals and which furthermore have start and stop times aligned with the start and stop times of the repetition time intervals. Specifically, the repetition intervals and the dividing time intervals may be substantially identical. Alternatively, the division may be into time intervals that are (possibly substantially) smaller than the repetition intervals. However, if the smaller time intervals of the division are synchronized relative to the repetition intervals, corresponding segments in different repetition intervals may still be identical in the absence of any degradation or noise. The synchronization may either be automatic. e.g. simply by the test generator and the time divider using the same timing signals, or may e.g. be achieved by a synchronization process (such as e.g. by maximizing a correlation measure).

The divider is coupled to a set processor 217 which receives the test interval signal components from the divider. The set processor 217 is arranged to generate a number of sets of test interval signal components. In the specific example, each set comprises two test interval signal components, and thus the set processor 217 generates a number of pairs of test interval signal components.

For brevity and clarity each test interval signal component will in the following be referred to as a signal block.

The pairs of signal blocks are fed to a similarity processor 219 which is arranged to determine a similarity value for each of the sets generated by the set processor 217. The similarity value for a set of signal blocks is indicative of how similar the signal blocks are, i.e. it indicates how similar the microphone signal is in the time intervals included in the individual set.

It will be appreciated that any suitable similarity value for determining how similar two signals are may be used. Specifically, a cross-correlation value may be generated and used as a similarity value. In case each set comprises more than two signal blocks, similarity values may be determined on a pair by pair basis and a similarity value for the entire set may be determined as an average or accumulated similarity value.

The similarity processor 219 is coupled to an interference estimator 221 which is further coupled to the set processor 217 and to the calibration processor 211. The interference estimator 221 is arranged to generate an interference measure for the different signal blocks based on the generated similarity measures. Specifically, an interference estimate for a first signal block is generated based on the similarity values determined for sets in which the first signal block is included. Thus, in the system of FIG. 2, the interference measure for a signal block is determined in response to the similarity values for at least one set comprising that signal block.

As a specific example, the interference measure for the first signal block may be generated as an average similarity value for the sets in which the signal block is included, possibly in comparison to an average similarity value for sets in which the first signal block is not included. As another example, the interference measure may be determined to correspond to the maximum similarity value for a set in which the first signal block is included.

The interference measure is fed to the calibration processor 211 which uses the interference measure in the calibration process. For example, the calibration processor may use the interference measure as a reliability value for the generated adaptation parameters. As another example, the calibration processor 211 may perform the calibration using only signal blocks for which the interference measure is sufficiently high thereby being indicative of the audio interference being sufficiently low.

The inventors have realized that audio interference is typically non-stationary and that this can be exploited to generate an interference estimate. In the presence of a non-stationary interference, the captured microphone signal is likely to vary more than if the non-stationary interference is not present. This is in the system of FIG. 2 exploited to generate an interference measure. Indeed, the similarity between signal blocks is likely to decrease substantially in the presence of a significant non-stationary interference source. For a given signal block a low similarity value for a comparison with a signal block at a different time is therefore an indication of there being interference present whereas a higher similarity value is typically indicative of a no or less interference being present.

The effect is particularly significant when combined with the generation and rendering of a specific test signal with repetition features that are synchronized with the time intervals of the signal blocks. In such scenarios, if there is no noise or interference, the microphone signal will be (substantially) identical to the test signal, and thus the different signal blocks will also be (substantially) identical resulting in the similarity value having a very high value. As the (non-stationary) interference increases, this will impact the captured audio signal differently at different times and thus will result in the signal blocks being increasingly different. Accordingly, the similarity value between two signal blocks decreases as the interference increases.

The similarity values for a given set of signal blocks accordingly decreases as the interference increases. Thus, for a given signal block the similarity value for the sets in which the signal block is included provides a good indication of the degree of audio interference present.

The described approach may provide improved adaptation of audio processing algorithms, such as for speech enhancement or echo cancellation. Adaptation routines for e.g. speech enhancement usually assume the presence of only relevant sound sources. For example, to tune an acoustic echo cancellation system, the signal captured by the microphone is assumed to only contain the signal produced by the loudspeaker (i.e. the echo). Any local disturbances such as noise sources or near-end speakers in the local environment will result in a deterioration of the resulting performance. In practice, the absence of any interference is typically not feasible but rather the captured signal is typically contaminated by audio interference produced in the near-end environment, as for example, near-end users moving or talking, or local noise sources such as ventilation systems. Therefore, the system parameters determined by the adaptation routine will typically not be a faithful representation of the acoustic behavior of the devices and local environments.

The system of FIG. 2 is capable of evaluating the interference in individual time segments of typically relatively short duration. In particular, it may provide an efficient signal integrity check system which can detect local interference in individual time segments. Accordingly, the adaptation process can be adapted e.g. by using the signal only in the segments for which there is sufficiently low interference. Thus, a more reliable adaptation and thus improved performance of the audio processing can be achieved.

A particular advantage of the system of FIG. 2 is that the interference estimation may be provided by functionality that is independent of the underlying adaptation algorithm and indeed of the audio process being adapted. This may facilitate operation and implementation, and may in particular provide improved backwards compatibility as well as improved compatibility with other equipment forming part of the audio system. As a specific example, the interference estimation may be added to an existing calibration system as additionally functionality that discards all signal blocks for which the interference estimate is too high. However, for the signal blocks that are passed to the adaptation process, the same procedure as if no integrity check was applied may be used and no modifications of the adaptation operation or the sound processing is necessary.

It will be appreciated that different approaches for generating the test signal may be used and that the test signal may have different characteristics in different embodiments.

Figure 3:
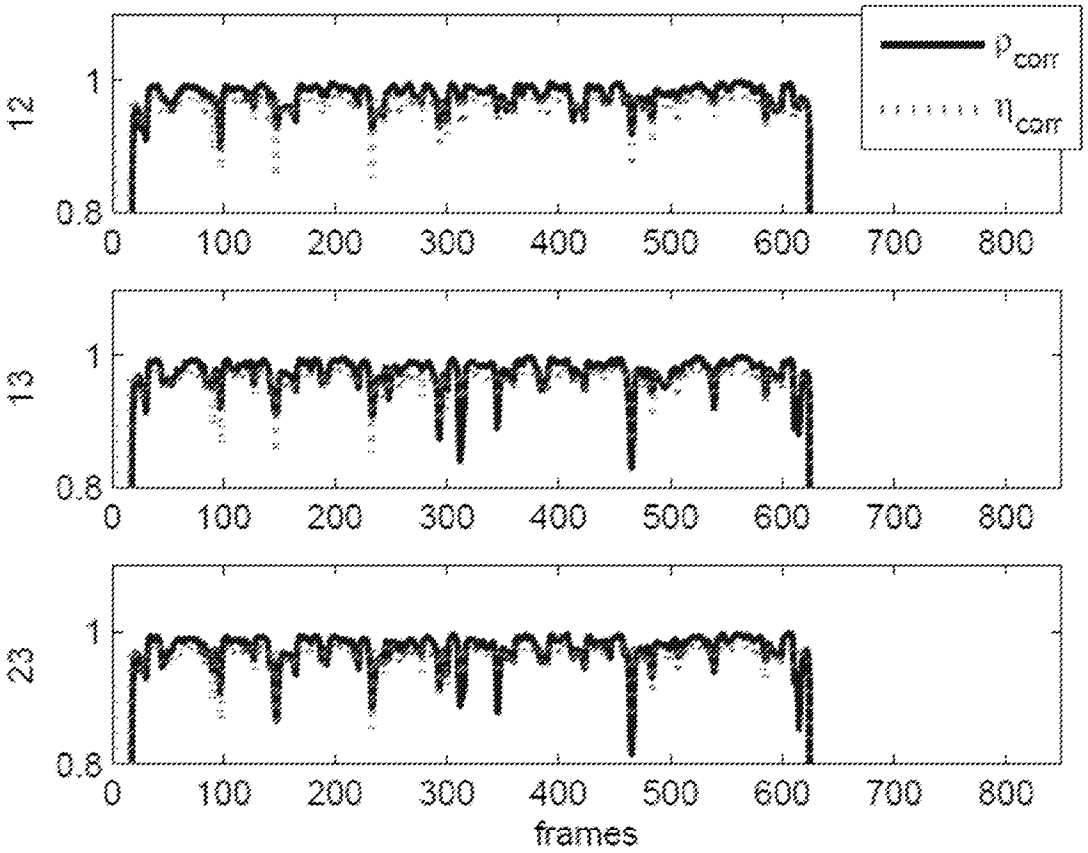
FIGS. 3-10 illustrate experimental results for an audio processing system in accordance with some embodiments of the invention.

In the example of FIG. 3, the test signal comprises a repeating signal component. For example, the signal may have a specific waveform which is repeated at regular intervals. In some embodiments, the signal in each repetition interval may have been designed to allow a full calibration/estimation operation. For example, each repetition interval may include a full frequency sweep or may comprise a single Dirac like pulse with the repetition intervals being sufficiently long to allow a full impulse response before the next pulse. In other embodiments, repetition intervals may be relatively short and/or the repetition signal may be a simple signal. For example, in some examples, each repetition interval may correspond to a single sine wave period. The test signal accordingly has repeating characteristics although the exact repetition characteristics may vary substantially between different embodiments. The test signal may in some embodiments only have two repetitions but in most embodiments, the test signal has significantly more repetitions and indeed may often have ten or more repetitions.

In some embodiments, the test signal may be a prerecorded signal stored in memory. The stored signal may already be composed of N periods, or the stored signal may correspond to one repetition which is then repeated.

As another example, the test signal is synthesized using a model, such as e.g. a model of speech production where the model parameters are either fixed or estimated from features of the far-end and/or microphone signals which have been extracted during run-time. Such features can include pitch information, time-domain waveform characteristics such as crest-factor, amplitude, envelopes, etc.

In many embodiments, it is desirable if the test signal meets the following requirements:

1. The energy in the spectrum of interest should be sufficient to allow for proper adaptation of relevant parameters related to the speech enhancement algorithm. For speech applications this would mean energy in the speech spectrum (e.g. between 300 and 4000 Hz).

2. The number of repetitions should be sufficiently high. In some embodiments, only two repetitions will be needed but in many embodiments a substantially higher number of repetitions are used. This may improve the noise robustness of the operation.

It will be appreciated that the divider 215 may use different approaches for dividing the microphone signal into signal blocks.

The divider 215 may align the signal blocks with the repetition intervals and specifically may align the signal blocks such that the test signal is identical for the time intervals that correspond to the different signal blocks.

It will be appreciated that the alignment may be approximate, and e.g. that some uncertainty in the synchronization may reduce the accuracy of the generated interference estimate but may still allow one to be generated (and to be sufficiently accurate).

In some embodiments, the time intervals may not be aligned with the repetition intervals, and e.g. the offset from a start time to the start of a repetition of the test signal may vary between different intervals. In such embodiments, the similarity value determination may take such potential time offsets into account, e.g. by offsetting the two signal blocks to maximize the similarity value. For example, cross-correlations may be determined for a plurality of time offsets and the highest resulting cross-correlation may be used as the similarity value. In such cases the time intervals may be longer than the repetition intervals and the intervals over which the correlation is determined may be equal to or possibly shorter than the repetition intervals. In some embodiments, the correlation window may be larger than the repetition interval and may include a plurality of repetition intervals. Typically, the window over which the similarity value is determined will be close to the duration of the time interval corresponding to each signal block in order to generate as reliable an estimate as possible.

It will be appreciated that the time intervals (also referred to as time segments) of signal blocks may be shorter, longer or indeed the same as the repetition intervals.

For example, in some embodiments, the test signal may be a pure tune and each repetition interval may correspond to a single sine-wave which is repeated. In such an example, the repetition time intervals may be very short (possibly around 1 msec), and the time segments for each signal block may be substantially larger and include a potentially large number of repetitions. For example, each time segment may be 20 msec and thus include 20 repetitions for the audio signal.

In other embodiments, the time segments may be selected to be substantially identical to the repetition interval. For example, the test signal may include a frequency sweep with a duration of 100 msec, with the sweep being repeated a number of times. In such an example, each time segment may be selected to have a duration of 100 msec and thus correspond directly to the repetition interval.

In yet other embodiments, each time segment may be substantially lower than the repetition intervals. For example, the test signal may be a sample of music of 5 seconds duration which is repeated e.g. 3 times (providing total length of 15 sec). In this case, the time segments may be selected to correspond to e.g. 32 msec (corresponding to 512 samples at a sample rate of 16 kHz). Although such small signal blocks do not contain the entire repetition sequence, they can e.g. be compared to corresponding signal blocks for other repetition intervals. The shorter duration not only allows a facilitated operation but may also allow a finer temporal resolution of the interference measure, and may in particular allow the selection of which signal segments to use for the adaptation to be with a finer temporal resolution.

The number of signal blocks generated will depend on the specific embodiment and the preferences and requirements of the specific application. However, in many embodiments, the duration of each signal block is typically no less than 10 msec and no more than 200 msec. This allows a particularly advantageous operation in many embodiments.

It will also be appreciated that the approach used by the set processor 217 may vary depending on the particularly preferences and requirements of the individual embodiment.

In many embodiments, the signal blocks are arranged into sets comprising of only two signal blocks, i.e. pairs of signal blocks are generated. In other embodiments, sets of three, four or even more signal blocks may be generated.

In some embodiments, the set processor 217 may be arranged to generate all possible sets of combinations of the signal blocks. For example, all possible pair combinations of signal blocks may be generated. In other embodiments, only a subset of possible pair combinations is generated. For example, only half or a quarter of the possible pair combinations may be generated.

In embodiments where only a subset of combinations is represented in the generated sets, the set processor 217 may use different criteria in different embodiments. For example, in many embodiments, the sets may be generated such that the time difference between signal blocks in each set is above a threshold. Indeed, by comparing signal blocks with larger time offsets, it is more likely that the non-stationary audio interference is uncorrelated between the signal blocks and accordingly an improved interference measure can be generated.

For example, when generating pairs, the set processor 217 may not select signal blocks that are consecutive but rather select signal blocks that have at least a given number of intervening signal blocks.

In some embodiments, each signal block is included in only one set. However, in most embodiments, each signal block is included in at least two signal blocks, and indeed in many embodiments each signal block may be included in 2, 5, 10 or more sets. This may reduce the risk of overestimating the interference for some signal blocks. For example, if a similarity value for a pair of signal blocks is low, thereby indicating that there is substantial audio interference present, this may result from interference in only one of the signal blocks. For example, if there is no audio interference in one signal block of the pair whereas the other one experiences a high degree of interference, this will result in a low correlation value and thus a low similarity value. However, it may not be possible to determine which signal block experiences the audio interference and accordingly both signal blocks could be rejected based on this comparison.

However, if the signal blocks are included in more pairs, there is an increased chance that the clean signal block will be paired with another relatively clean signal block in at least one of the pairs. Accordingly, the correlation value for this pair will be relatively high, and thus the similarity value will be relatively high. This pairing will accordingly reflect that both signal blocks are clean and can be used for further processing.

It will be appreciated that the number of sets may be chosen to provide a suitable trade-off between computational resource demands, memory demands, performance and reliability.

The similarity processor 219 may use any suitable approach for determining a similarity value for a set.

For example, for a pair of signal blocks, a cross-correlation value may be determined and used as a similarity value.

As a specific example, a similarity corresponding to the normalized cross-correlation between the $i^{th}$ and $j^{th}$ signal blocks may be calculated as:

$$\rho_{ij} = \frac{E\{z_i(n)z_j(n)\}}{\sqrt{E\{z_i^2(n)\}E\{z_j^2(n)\}}}$$

where $z_x(n)$ indicates the n'th sample of the x'th signal block and E{ } indicates the expected value operator. The expected value may be computed over signal blocks or subsegments of signal blocks, in which case $$\rho_{ij} = \frac{Z_i^T(n)Z_j(n)}{\sqrt{(Z_i^T(n)Z_i(n))(Z_i^T(n)Z_j(n))}}$$

where $Z_x(n)$ corresponds to a column vector of signal samples contained in a given subsegment and T denotes the vector transpose operation.

The microphone signal may be considered to consist of three components, namely a test signal component, a stationary noise component (typically additive white Gaussian noise), and non-stationary audio interference. The interference measure seeks to estimate the latter component.

In some embodiments, the similarity processor 219 and/or the interference estimator 221 may comprise functionality for estimating the test signal component and/or the stationary noise component. The similarity value and/or the interference measure may then be compensated in response to these estimates.

For example, increasing test signal energy may reduce the normalized correlation value. Accordingly, if the test signal energy can be estimated, the generated interference measure may be compensated accordingly. E.g. a look-up-table relating an energy level to a compensation value may be used with the compensation value then being applied to each similarity value or to the final interference measure.

The signal energy may e.g. be estimated based on the sets of signal blocks. For example, the set having the highest similarity value for all sets may be identified. This is likely to have the lowest possible audio interference and accordingly the signal energy of the test signal component may be estimated to correspond to the energy of the signal block having the lowest energy.

Similarly, stationary noise may affect the similarity values and by compensating the similarity values and/or interference measure based on a stationary noise estimate, improved performance can be achieved. The stationary noise estimate may specifically be a noise floor estimate. A noise floor stationary noise estimate may for example be determined by decomposing the time-domain signal into a multitude of frequency components and tracking the minimum envelope value of each component. The average power across frequencies may be used as an estimate of the noise floor in the time domain.

The interference measure for a given signal block may specifically be generated by identifying the highest similarity value for sets in which the signal block is included, and then setting the interference measure to this value (or a monotonic function of this value).

This will ensure that the interference measure reflects the best comparison that was achieved which is likely to happen when both the signal blocks experienced a minimum of interference. The approach may specifically reflect that if one close match can be found for a signal block, it is likely that both of these signal blocks experience low interference.

In other embodiments more complex interference measures may be determined. For example, a weighted average of all similarity values for a given signal block may be used where the weighting increases for increasing similarity values.

The calibration processor 211 is arranged to take the interference measure into account when determining adaptation parameters for the audio application. Specifically, the contribution of each signal block may be weighted in dependence on the interference measure such that signal blocks for which the interference measure is relatively high have more impact on the adaptation parameters generated than signal blocks for which the interference measure is relatively low. This weighting may for example in some embodiments be performed on the input signal to the calibration processor 211, i.e. on the signal blocks themselves. In other examples, the adaptation parameter estimates generated for a given signal block may be weighted according to the interference measure before being combined with parameter estimates for other signal blocks.

In some embodiments, a binary weighting may be performed, and specifically signal blocks may either be discarded or used in the adaptation based on the interference measure. Thus, signal blocks for which the interference measure is below a threshold (corresponding to a similarity value above a threshold) may be used in the adaptation whereas signal blocks for which the interference measure is above the threshold are discarded and not used further. The threshold may in some embodiments be a fixed threshold and may in other embodiments be an adaptive threshold.

For example, as previously described, the correlation value and thus the interference measure may depend on the test signal component energy and on the stationary noise. Rather than compensating the similarity values or the interference measure, the threshold for discarding or accepting the signal blocks may instead be modified in response to the test signal energy estimate or the stationary noise estimate.

A similar approach of using a look-up-table of compensation values determined during manufacturing tests may for example be used with the resulting compensation value being applied to the threshold.

In the previous example, the divider 215 may generate a large number of signal blocks which are stored in local memory for combined processing by the set processor 217 and the similarity processor 219. However, it will be appreciated that many other implementations may be used and specifically that a more sequential processing may be used.

Thus, rather than generating sets for all signal blocks followed by similarity values of all blocks etc. The steps may be performed individually e.g. for each new block.

For example, when an adaptation process is started, the test generator 213 may generate a test signal. A first signal block may be generated and stored in local memory. After a suitable delay (e.g. simply corresponding to a signal block time interval), a second signal block may be generated. This is then compared to the stored signal block to generate a similarity value. If the similarity value is sufficiently high, the new signal block is fed to the calibration processor 211 for further processing.

When a signal block is received that results in a similarity value below a threshold, the new signal block may replace the stored signal block and thus be used as the reference for later signal blocks. In some embodiments, a decision between keeping the stored reference and replacing it with the newly received signal block may be made dynamically. For example, the signal block having the lowest signal energy may be stored as this is likely to be the case for the signal block with the lowest audio interference energy (in particular if the interference and the test signal are sufficiently decorrelated).

In the following a specific example of an operation of an embodiment of the invention will be described. The example is applicable to the system of FIG. 2.

The example relates to a speech enhancement system for acoustic echo suppression with the system being adapted based on an audio signal. Such a system usually consists of an echo canceller, followed by a post-processor which suppresses any remaining echoes and is usually also based on a specific model of non-linear echo. The test signal is played back via the device's loudspeaker and the captured microphone signal is recorded.

Let the discrete-time tuning signal x(n) of length NT samples be periodic with period T samples, $$x(n)=x(n-T),\ n=T,T+1,\ \ldots\ ,NT-1,$$

where N is the number of periods. Later, the notation will be simplified and it will be assumed that the signal is divided into N contiguous and identical parts each of length T denoted by $x_k(n)$ for k=1, . . . , N.

It is assumed that the acoustic echo path is a non-linear time-varying system where only the linear part of the echo path is time-varying and follows the time-invariant non-linear part. The microphone signal corresponding to each repetition $x_k(n)$ is given by $$z_k(n)=e_k(n)+s_k(n)+v_k(n),\ k=1\ \ldots\ N,$$

where the echo component $e_k(n)$ contains both linear and non-linear components, $s_k(n)$ is assumed to be a non-stationary audio interference such as speech, and $v_k(n)$ is assumed to be stationary background noise which can be modelled as a white noise process. The non-stationary interference and background stationary noise are assumed to be uncorrelated with each other and across periods, $$E\{s_i(n)s_j(n)\}=0$$

$$E\{v_i(n)v^*_j(n)\}=0$$

$$E\{v_i(n)v^*_i(n)\}=\sigma_{v^2}$$

where E{•} denotes the expected value and 1≤i,j≤N.

It is also assumed that the signals are independent and zero-mean (high-pass filtered), $$E\{e_k(n)s_k(n)\}=0$$

$$E\{s_k(n)v_k(n)\}=0$$

$$E\{e_k(n)v_k(n)\}=0.$$

The system includes a signal integrity check which verifies the recorded microphone signal and discards the signal blocks/segments experiencing too much interference.

This is achieved by computation of a similarity measure between respective blocks of $z_k(n)$ for 1≤k≤N.

The total number of computed similarities is in the specific example $$\binom{N}{2}$$

per block, where $$\binom{n}{r}=\frac{n|}{r|(n-r)|}.$$

If two blocks only contain the echo/test signal (and the stationary-noise component), they will be similar, and can be used for adapting the system. However, if at least one of the blocks in the pair-wise comparison contains significant interference, then other pairs of blocks are tested. If no two blocks are similar then the block is not used in the adaptation routine. For increased robustness it is often desirable to choose N>2 to increase the probability that at least one pair of blocks is similar.

Different similarity measures may be used. In the following some specific options are included:

Correlation-Based Similarity Measure

The normalized cross-correlation between the $i^{th}$ and $j^{th}$ block may as previously mentioned be used as a similarity value. This may specifically be given as:

$$\rho_{ij}=\frac{E\{z_i(n)z_j(n)\}}{\sqrt{E\{z_i^2(n)\}E\{z_j^2(n)\}}}$$

with $0\le\rho_{ij}\le1$.

The cross-correlation may accordingly be given as:

$$\rho_{ij}=\frac{E\{e_i(n)e_j(n)\}}{\sqrt{(E\{e_i^2(n)\}+E\{s_i^2(n)\}+\sigma_v^2)(E\{e_j^2(n)\}+E\{s_j^2(n)\}+\sigma_v^2)}}$$

It should be noted that the presence of a non-stationary interferer reduces the value of $\rho_{ij}$. Therefore, assuming the absence of any audio interference in the $i^{th}$ and $j^{th}$ signal blocks/segments, a lower bound for the threshold determining whether to include or discard blocks for the adaptation may be given by:

$$\eta_{corr} = \frac{E\{e_i(n)e_j(n)\}}{\sqrt{(E\{e_i^2(n)\} + \sigma_v^2)(E\{e_j^2(n)\} + \sigma_v^2)}}$$

where $$\eta_{corr} \geq \rho_{ij}$$

since $E\{s_i^2(n)\}, E\{s_j^2(n)\} \geq 0$. Note that although the echo e(n) also contains nonlinear components, an estimate of the cross-correlation and second-moment terms can be computed using the echo signal estimated by a linear adaptive filter. Depending on the step-size and filter length, the adaptive filter can track non-linearities to some extent.

If it is assumed that the system is time-invariant, i.e. $e_k(n)=e(n)$ for all k, then the threshold $\eta_{corr}$ reduces to $$\eta_{corr} = \frac{ENR}{1 + ENR},$$

where $ENR=E\{e^2(n)\}/\sigma_v^2$ denotes the echo-to-noise ratio.

Mean-Squared Difference-Based Similarity Measure

A possible mean-squared difference-based similarity measure is given by $$\delta_{ij}=E\{(z_i(n)-z_j(n))^2\},$$

where $\delta_{ij} \geq 0$. Substituting $z_i(n)$ and $z_j(n)$, $$\delta_{ij}=(E\{e_i^2(n)\}+E\{e_j^2(n)\})+(E\{s_i^2(n)\}+E\{s_j^2(n)\})-2(E\{e_i(n)e_j(n)\}-\sigma_v^2).$$

Assuming the absence of a audio interference ($s_i(n)=s_j(n)=0$), this can be simplified to $$\eta_{diff}=(E\{e_i^2(n)\}+E\{e_j^2(n)\})-2(E\{e_i(n)e_j(n)\}-\sigma_v^2),$$

which can be used as a threshold for detecting whether one of two frames contains audio interference, with $$\eta_{diff} \leq \delta_{ij}.$$

If a time-invariance is assumed, i.e. $e_k(n)=e(n)$ for all k, then the threshold $\eta_{diff}$ reduces to $$\eta_{diff}=2\sigma_v^2.$$

Power-Based Similarity Measure

A measure which is less sensitive to a signal's fine structure is given by $$\mu_{ij}=|E\{z_i^2(n)\}-E\{z_j^2(n)\}|.$$

Expanding the microphone signal terms, $$\mu_{ij}=|(E\{e_i^2(n)\}-E\{e_j^2(n)\})+(E\{s_i^2(n)\}-E\{s_j^2(n)\})|.$$

Assuming the absence of audio interference ($s_i(n)=s_j(n)=0$), this can be simplified to $$\eta_{pow}=|E\{e_i^2(n)\}-E\{e_j^2(n)\}|.$$

A complication with this value is that the sign of $E\{s_i^2(n)\}-E\{s_j^2(n)\}$ can be positive or negative making it less suitable as a threshold.

Zero-Crossing Count Difference Measure

The zero crossing rate or count is a feature which is particularly suitable to distinguish music from speech. The zero-crossing count difference (ZCCD) measure can be defined as:

$$ZCCD_{ij}=|ZCC(z_i(n))-ZCC(z_j(n))|,$$

where ZCC(•) counts the number of zero crossings.

Mutual Information Cross-Correlation Index

The mutual information cross-correlation index (MICI) can be given by $$MICI_{ij} = E\{z_i^2(n)\} + E\{z_j^2(n)\} - \sqrt{(E\{z_i^2(n)\} + E\{z_j^2(n)\})^2 - 4E\{z_i^2(n)\}E\{z_j^2(n)\}(1-\rho_{ij})^2}$$

which equals zero when $z_i(n)$ and $z_j(n)$ are linearly dependent and increases as the dependence decreases. This measure also makes use of the normalized cross-correlation function $\rho_{ij}$ between the two signals.

The approach may operate as follows.

First the test signal is rendered with the test signal comprising N repetitions. The signal is captured by the microphone 201.

The system then proceeds to estimate the noise floor of the captured signal.

The microphone signal is split into N contiguous parts of length T samples. The division may ignore in the microphone signal for an initial period after the onset of the test signal in order to allow the effect to settle (in particular, in order to allow reverberation of the test signal to be present in the first signal blocks generated).

For each segment a linear acoustic echo is estimated using an adaptive filter. This may provide a level estimate for the signal energy of the echo/test signal as captured by the microphone.

For each block, a threshold determining whether the block should be accepted or not is determined using the echo estimate and the noise floor estimate to derive a threshold. The threshold can be updated for each block/segment.

The final threshold values per frame can be based on either the maximum (in case of using $\rho_{ij}$) or the minimum (in case of using δij) across all frames.

For each pair of blocks, the pair is categorized as similar or not depending on whether the measure exceeds (in case of using $\rho_{ij}$) or is below (in case of using δij) the given threshold.

With restrictive thresholds, it is inevitable that some transients in the echo response may cause a missed detection of a clean block. In other words, the block may be categorized as containing interference when in fact a transient condition, such as a movement, has caused a large difference to be detected. To prevent this, a form of detection smoothing may be employed, e.g. using median filtering. For example, let the value 1 denote that a current frame is similar to another and 0 that it is different. Given a buffer of the current frame detection and B−1 previous detections, if the number of similar frames is below a certain threshold, then the middle frame in the detection buffer is set to 0. If the number of similar frames is above a certain threshold then the middle frame is set to 1.

Another aspect to consider is how to derive the thresholds based on the echo estimate produced by the acoustic echo canceller. If the threshold value is updated every block, then the produced echo estimate is based on the previous adaptive filter coefficients. Therefore, after each update of the filter coefficients, a new echo estimate should preferably be produced to improve the synchronicity between the current similarity measure and respective threshold value.

Since the thresholds presented above are very restrictive it will often be appropriate to relax them, e.g. by scaling such as $$\eta'_{corr}=\epsilon\eta_{corr},\epsilon<1$$

$$\eta'_{diff}=\gamma\eta_{diff},\gamma>1$$

Experimental data for a scenario in which a test signal consisting of three periods have been used are presented in FIGS. 3-10.

In the example, the test signal was rendered via the loudspeakers of a television. The signal block length was set to 512 samples and the adaptive filter length for estimating the echo path was set to 512 samples. An NLMS algorithm was employed to estimate the linear echo. Furthermore, the values of $\epsilon$ and $\gamma$ in the above formulas for scaling the threshold were are set to 0.98 and 3.0, respectively. A median filter of length 10 (block detections) is also used to smooth the detections, and corresponds to approximately 320 ms for the given frame size.

Ideally, the approach should be robust to movements in the local environment which can change the acoustic echo path impulse response. In the following set of results, a person standing in the room moves to a different location between periods of the test signal to effectively change the acoustic echo path. FIGS. 3-6 show the similarity measures and results using the correlation- and difference-based similarity measures. Note that both measures show robustness against movements in the local acoustic environment which is important since changes in the acoustic path should not be cause false detections that an interferer is present.

Figure 4:
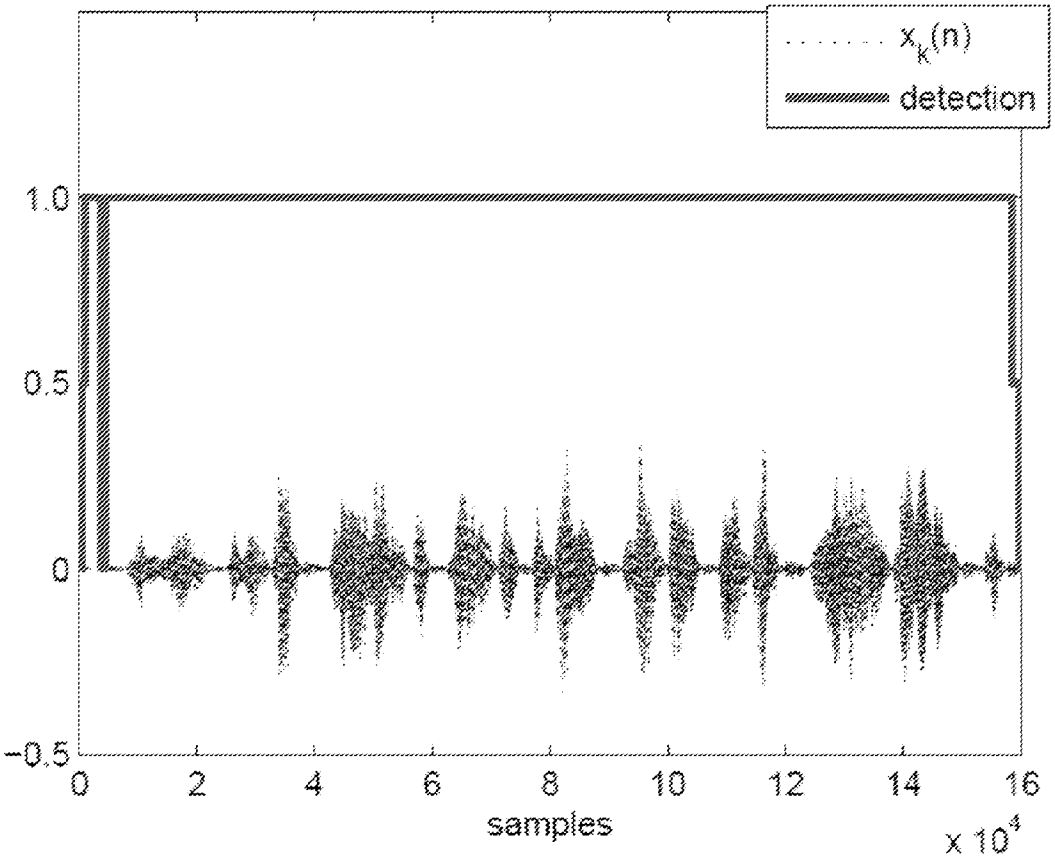
Figure 5:
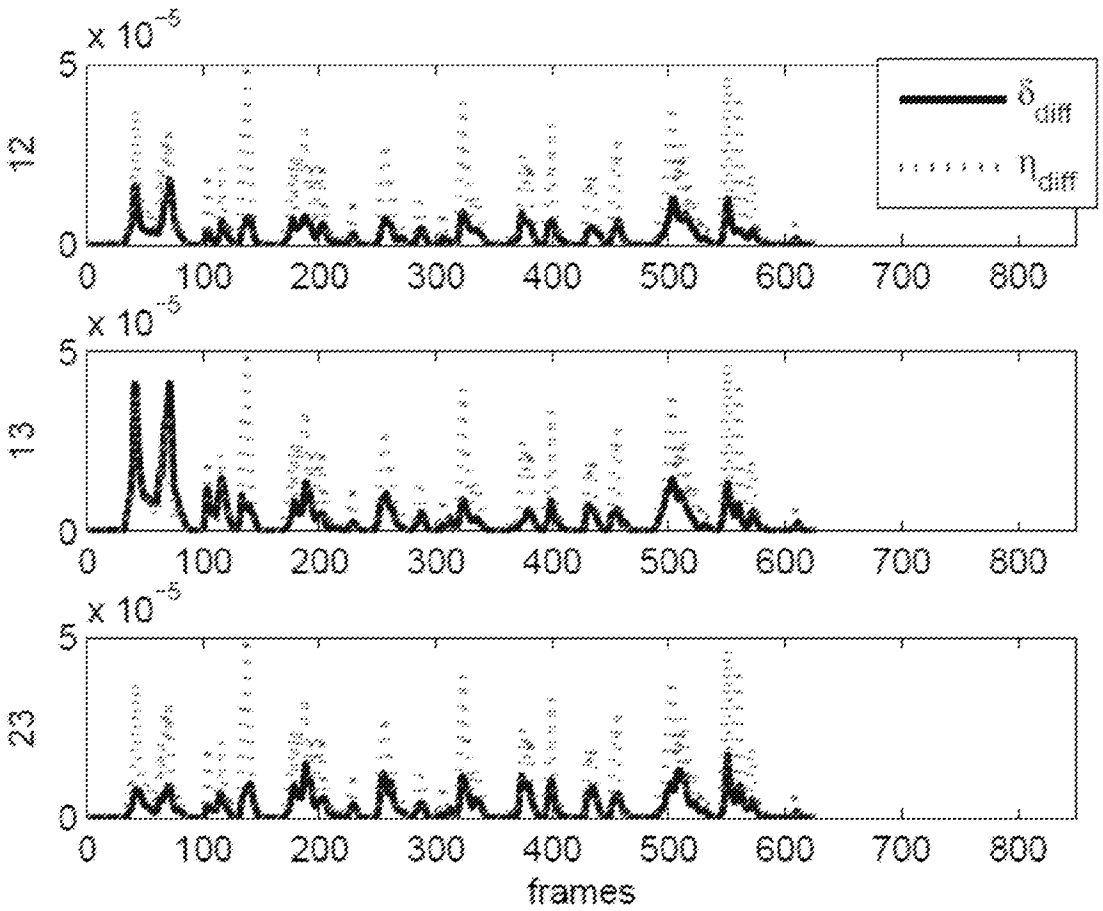
Figure 6:
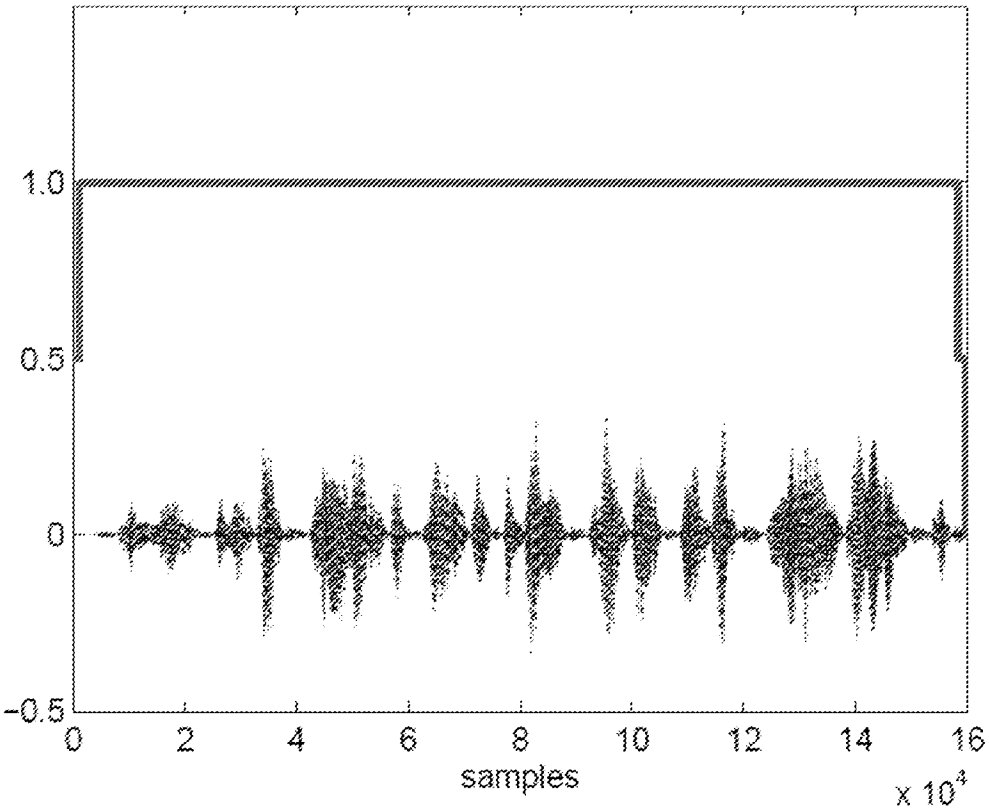

Specifically, FIG. 3 illustrates a correlation-based similarity measure and threshold for three periods of a test signal with local movements only. The y-axis labels indicate the test signal periods involved in the similarity measure, e.g. 12 denotes the similarity measure between the first and second period. FIG. 4 illustrates the resulting detection performance using a correlation based similarity measure (with 1 denoting a block which is considered clean and 0 denotes a block which is considered to experience interference). FIG. 5 illustrates a mean-squared difference based similarity measure and threshold for three periods of a test signal with local movements only. FIG. 6 illustrates the same but for a mean-squared difference based similarity measure.

In the following examples, local speech interference is introduced during the recording of the test signal during the second half of each test period. Note that during the second half of the period, the adaptation discards the frames which contain interfering speech.

Figure 7:
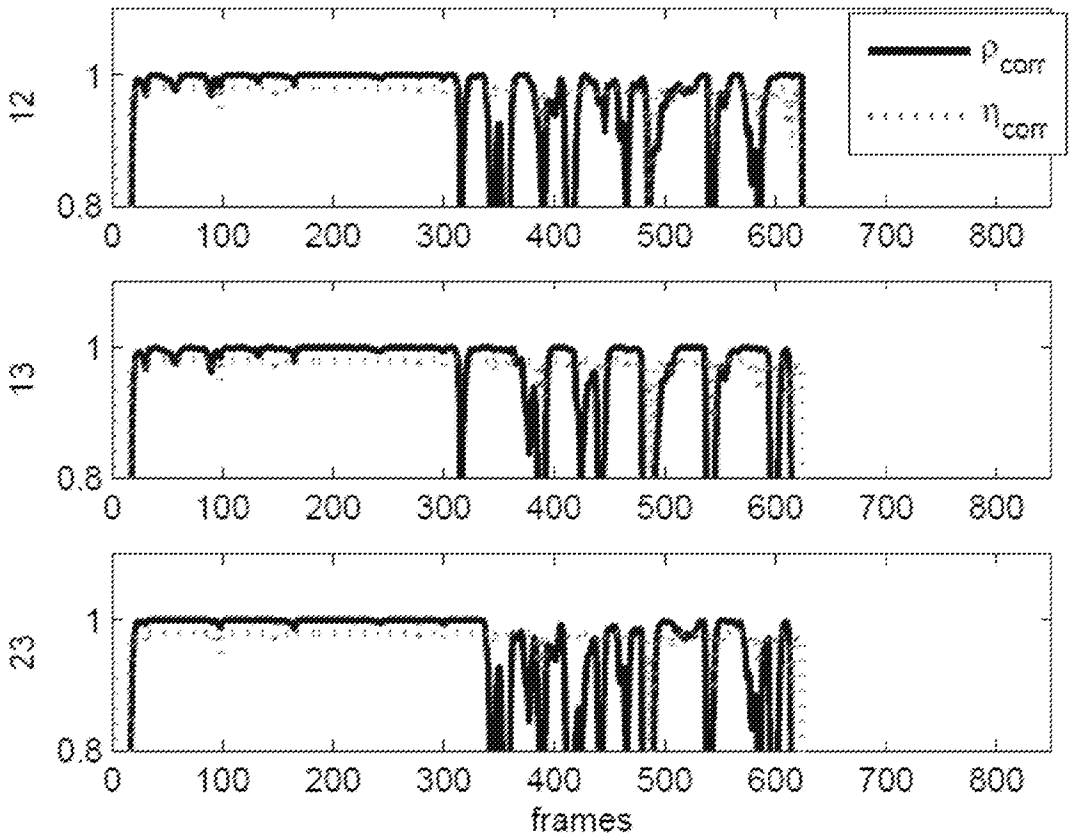
Figure 8:
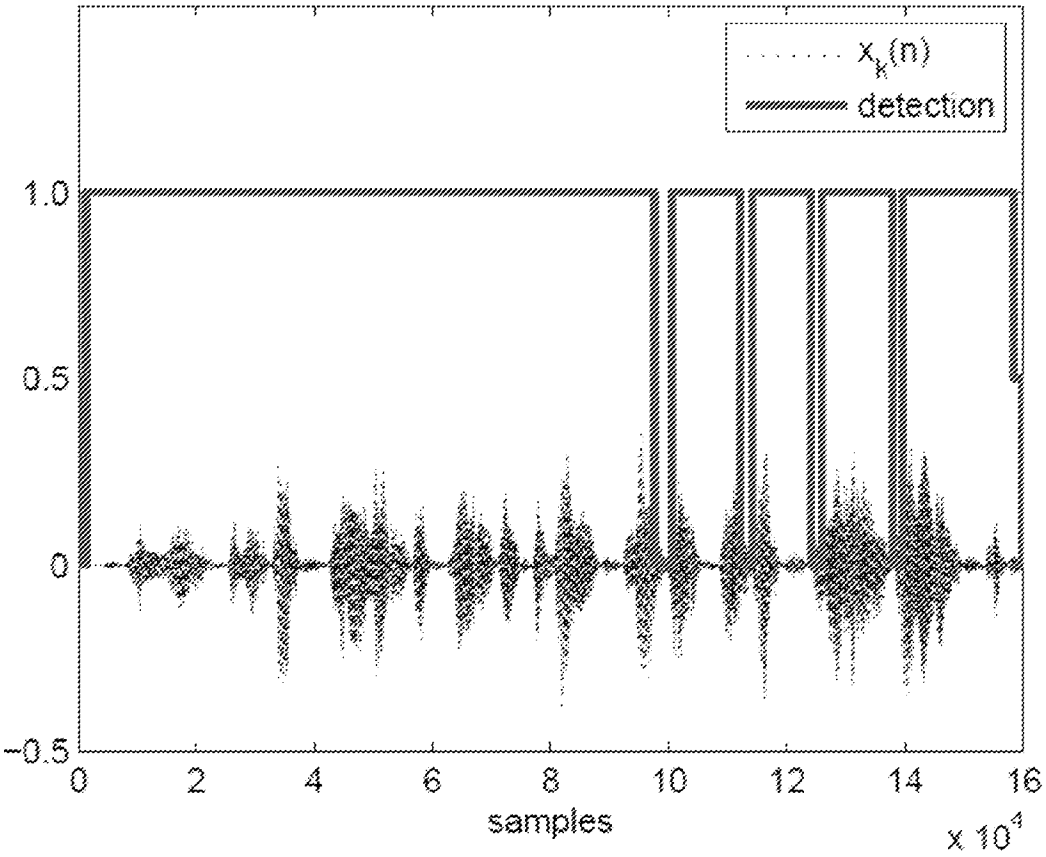
Figure 9:
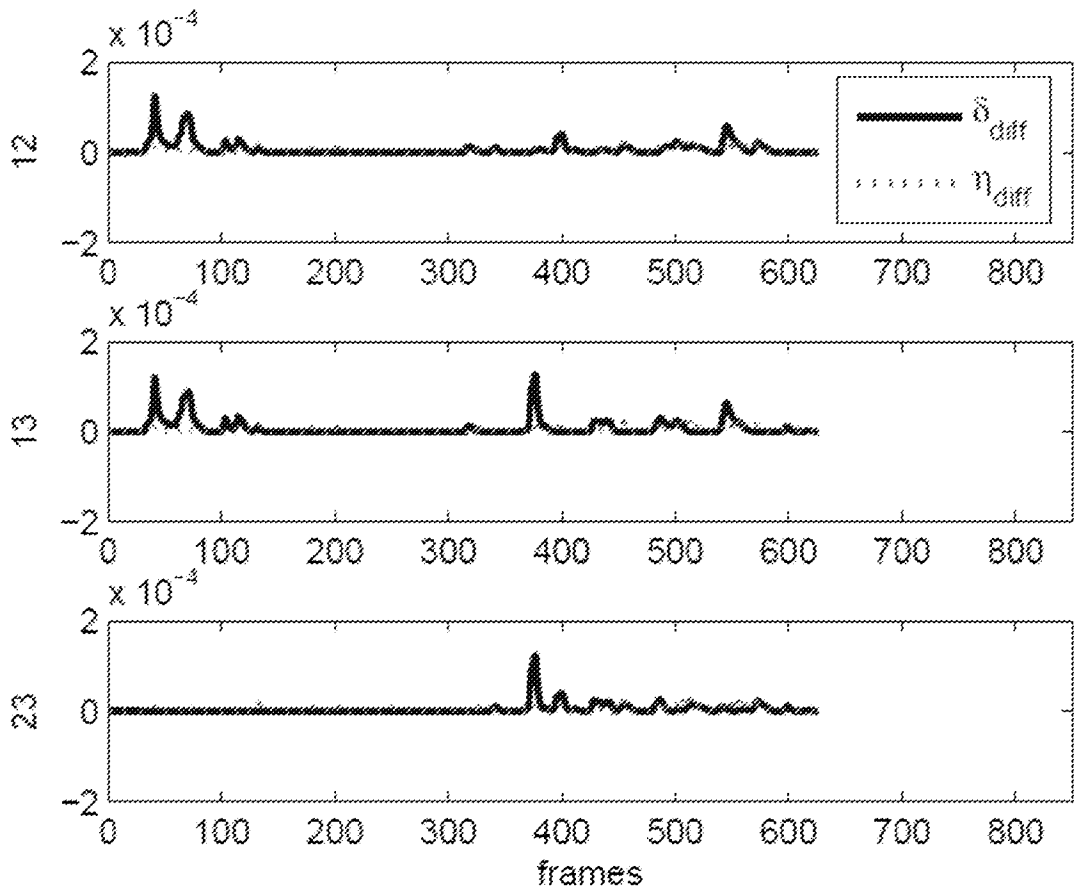
Figure 10:
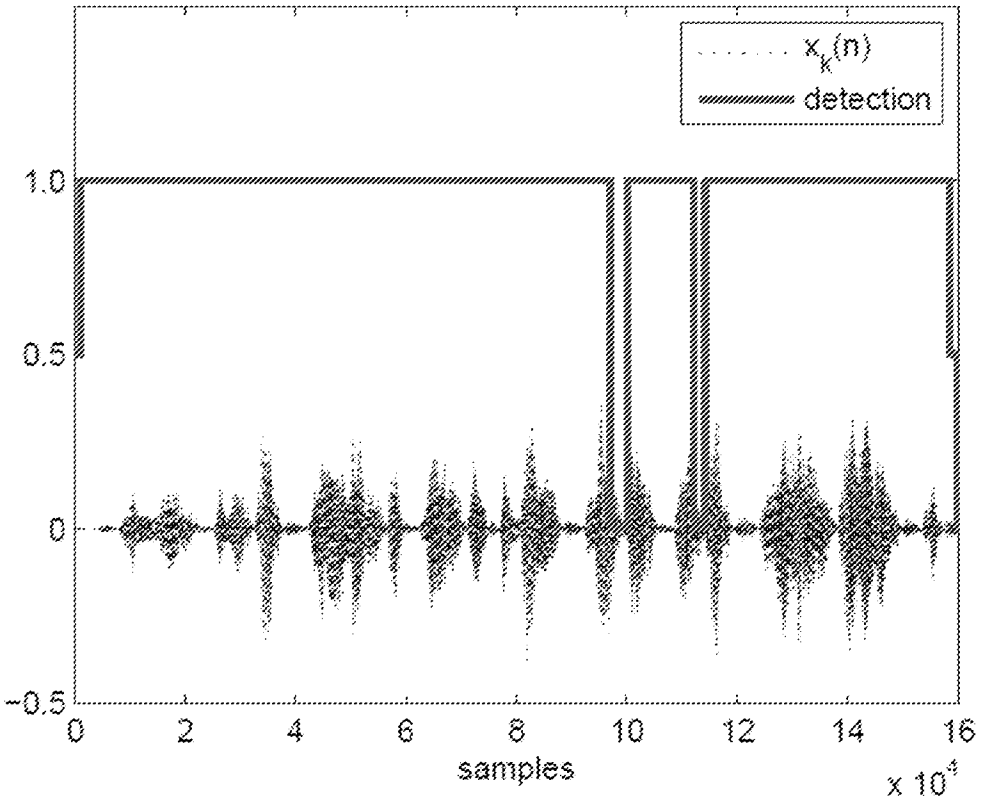

FIG. 7 illustrates a correlation-based similarity measure and threshold for three periods of a test signal with local speech interference. FIG. 8 illustrates the resulting detection performance using a correlation based similarity measure. FIG. 9 illustrates a mean-squared difference based similarity measure and threshold for three periods of a test signal with local speech interference. FIG. 10 illustrates the same but for a mean-squared difference based similarity measure.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An apparatus comprising:

a receiver for receiving a microphone signal from a microphone, the microphone signal comprising a test signal component corresponding to an audio test signal captured by the microphone;

a divider for dividing the microphone signal into a plurality of test interval signal components, each test interval signal component corresponding to the microphone signal in a time interval, wherein the audio test signal comprises a plurality of repetitions of an audio signal component, and a timing of the test interval signal components corresponds to a timing of the repetitions;

a set processor for generating sets of test interval signal components from the plurality of test interval signal components;

a similarity processor for generating a similarity value for each set of test interval signal components;

an interference estimator for determining an interference measure for individual test interval signal components in response to the similarity values.

2. The apparatus of claim 1 further comprising a calibration unit for adapting a signal processing in response to the test interval signal components, the adaptation unit being arranged to weigh at least a first test interval signal component contribution in response an interference estimate for the first time interval.

3. The apparatus of claim 2 wherein the calibration unit is arranged to discard test interval signal components for which the interference estimate is above a threshold.

4. The apparatus of claim 1 further comprising a stationary noise estimator arranged to generate a stationary noise estimate and to compensate at least one of the threshold and the interference estimate in response to the stationary noise estimate.

5. The apparatus of claim 4 wherein the stationary noise estimate is a noise floor estimate.

6. The apparatus of claim 1 further comprising a test signal estimator arranged to generate a level estimate for the test signal component and to compensate at least one of the threshold and the interference estimate in response to the level estimate.

7. The apparatus of claim 1 wherein the divider is arranged to divide the microphone signal into the plurality of test interval signal components in response to repetition characteristics of the audio test signal.

8. The apparatus of claim 1 wherein the interference estimator is arranged to, for a first test interval signal component of the plurality of test interval signal components, determine a maximum similarity value for similarity values of sets including the first test interval signal component; and to determine the interference measure for the first test interval signal component in response to the maximum similarity value.

9. The apparatus of claim 1 wherein the divider is arranged to generate at least two sets comprising at least a first of the test interval signal components.

10. The apparatus of claim 9 wherein each test interval signal component has a duration of no less than 10 msec and no more than 200 msec.

11. The apparatus of claim 1 wherein each set consists of two test interval signal components.

12. The apparatus of claim 11 wherein the divider is arranged to generate sets corresponding to all pair combinations of the test interval signal components.

13. A method of generating an audio interference measure, the method comprising:

receiving a microphone signal from a microphone, the microphone signal comprising a test signal component corresponding to an audio test signal captured by the microphone;

dividing the microphone signal into a plurality of test interval signal components, each test interval signal component corresponding to the microphone signal in a time interval, wherein the audio test signal comprises a plurality of repetitions of an audio signal component, and a timing of the test interval signal components corresponds to a timing of the repetitions;

generating sets of test interval signal components from the plurality of test interval signal components;

generating a similarity value for each set of test interval signal components; and determining an interference measure for individual test interval signal components in response to the similarity values.

14. The method of claim 13, wherein the interference measure for an individual test interval signal component is generated by identifying the highest similarity value for only those sets of test interval signal components in which the individual test interval signal component is included in the set.

15. The method of claim 14, wherein the method further comprises setting the interference measure to the identified highest similarity value.

16. A non-transitory computer readable storage medium, that is not a transitory propagating signal or wave, the medium modified by control information including instructions for performing a method of generating an audio interference measure, comprising:

in an apparatus, a processor;

receiving a microphone signal from a microphone, the microphone signal comprising a test signal component corresponding to an audio test signal captured by the microphone;

dividing the microphone signal into a plurality of test interval signal components, each test interval signal component corresponding to the microphone signal in a time interval, wherein the audio test signal comprises a plurality of repetitions of an audio signal component, and a timing of the test interval signal components corresponds to a timing of the repetitions;

generating sets of test interval signal components form the plurality of test interval signal components;

generating a similarity value for each set of test interval signal components; and determining an interference measure for individual test interval signal components in response to the similarity values.

17. The apparatus of claim 1, further comprising an application processor arranged to receive the microphone signal and process the signal for transmission to a remote communication unit.

18. The apparatus of claim 17, wherein the application processor is further arranged to receive audio data from the remote communication unit and process the received audio data to generate a signal to be rendered locally.

19. The apparatus of claim 17, wherein the interference measure is used to determine when a calibration is performed by the calibration processor.

20. The apparatus of claim 1, further comprising a calibration processor arranged to adapt the audio processing of the application processor by determining adaptation parameters for the audio processing.

21. The apparatus of claim 1, wherein the sets of test interval signal components from the plurality of test interval signal components comprise non-consecutive test interval signal components.

22. A method of generating an audio interference measure, the method comprising:

receiving a microphone signal from a microphone, the microphone signal comprising a test signal component corresponding to an audio test signal captured by the microphone;

dividing the microphone signal into a plurality of test interval signal components, each test interval signal component corresponding to the microphone signal in a time interval, wherein the audio test signal comprises a plurality of repetitions of an audio signal component, and a timing of the test interval signal components corresponds to a timing of the repetitions;

generating a first test interval signal component from the plurality of test interval signal components;

storing the first test interval signal component in a local memory;

generating a second test interval signal component from the plurality of test interval signal components;

comparing the second test interval signal component with the previously stored first test signal component to generate a similarity value;

determining if the generated similarity value exceeds a threshold;

determining an interference measure for the second test interval signal component.

23. The method of claim 22, further comprising replacing the first test interval signal component with the second test signal component in the local memory in the case where it is determined that the generated similarity value does not exceed the threshold.

24. The method of claim 22, further comprising replacing the first test interval signal component with the second test signal component in the local memory in the case where it is determined that the audio interference energy of the second test signal component is less than the audio interference energy of the first test signal component.

25. The method of claim 22, wherein the threshold is a fixed threshold.

26. The method of claim 22, wherein the threshold is an adaptive threshold.

27. The method of claim 22, wherein the threshold is updated every test interval.

28. An audio processing system, comprising:

a microphone arranged to generate a microphone signal capturing the sound in an acoustic environment, a receiver coupled to the output of the microphone, an application processor arranged to support or execute an audio application, the application processor configured to receive the microphone signal from the receiver and process the received signal in accordance with a specific audio application, an audio transducer configured to receive an audio signal from the application processor and generate a corresponding drive signal for the loudspeaker driver, a receiver for receiving a microphone signal from a microphone, the microphone signal comprising a test signal component corresponding to an audio test signal captured by the microphone;

a divider for dividing the microphone signal into a plurality of test interval signal components, each test interval signal component corresponding to the microphone signal in a time interval, wherein the audio test signal comprises a plurality of repetitions of an audio signal component, and a timing of the test interval signal components corresponds to a timing of the repetitions;

a set processor for generating sets of test interval signal components from the plurality of test interval signal components;

a similarity processor for generating a similarity value for each set of test interval signal components;

an interference estimator for determining an interference measure for individual test interval signal components in response to the similarity values.

29. The system of claim 28, wherein the audio application supports a two-way communication with a remote communication unit.

30. The system of claim 28, wherein the application processor processes the received signal using at least one processing method selected from the group consisting of: speech enhancement, echo cancellation, suppression of the received microphone signal and speech encoding.

31. The system of claim 28, wherein the application processor is further arranged to receive audio data from the remote communication unit and to process the received audio data to generate a signal to be rendered locally as a corresponding audio output signal.

32. A non-transitory computer readable storage medium, that is not a transitory propagating signal or wave, the medium modified by control information including instructions for performing a method of generating an audio interference measure, comprising:

in an apparatus, a processor:

receiving a microphone signal from a microphone, the microphone signal comprising a test signal component corresponding to an audio test signal captured by the microphone;

dividing the microphone signal into a plurality of test interval signal components, each test interval signal component corresponding to the microphone signal in a time interval, wherein the audio test signal comprises a plurality of repetitions of an audio signal component, and a timing of the test interval signal components corresponds to a timing of the repetitions;

generating a first test interval signal component from the plurality of test interval signal components;

storing the first test interval signal component in a local memory;

generating a second test interval signal component from the plurality of test interval signal components;

comparing the second test interval signal component with the previously stored first test signal component to generate a similarity value;

determining if the generated similarity value exceeds a threshold;

determining an interference measure for the second test interval signal component.

* * * * *